US005890451A

United States Patent [19]

Bruce

[11] Patent Number: 5,890,451

[45] Date of Patent: Apr. 6, 1999

[54] ANCHORING APPARATUS AND METHOD

[75] Inventor: Peter Bruce, Douglas, Isle of Man

[73] Assignee: Brupat Limited, Douglas, Isle of Man

[21] Appl. No.: 343

[22] PCT Filed: Jul. 22, 1996

[86] PCT No.: PCT/GB96/01755

§ 371 Date: Jan. 20, 1998

§ 102(e) Date: Jan. 20, 1998

[87] PCT Pub. No.: WO96/39324

PCT Pub. Date: Dec. 12, 1996

[30] Foreign Application Priority Data

Jul. 21, 1995 [GB] United Kingdom ..... 9514964

[51] Int. Cl.[6] ..... B63B 21/24

[52] U.S. Cl. ..... 114/297; 114/304

[58] Field of Search ..... 114/293–295, 297, 114/298, 301, 307, 304, 306

[56] References Cited

U.S. PATENT DOCUMENTS

| | | | |
|---|---|---|---|
| 3,151,594 | 10/1964 | Collipp | 114/293 |
| 3,685,479 | 8/1972 | Bruce | 114/294 |
| 4,019,455 | 4/1977 | Hungerford | 114/298 |
| 5,474,015 | 12/1995 | Bruce | 114/304 |

FOREIGN PATENT DOCUMENTS

WO 93/11028 6/1993 WIPO .

*Primary Examiner*—Jesus D. Sotelo
*Attorney, Agent, or Firm*—Thelen, Reid & Priest LLP

[57] ABSTRACT

A drag embedment normal load anchor ("Denla") comprises a fluke with a shank pivotally attached thereto, the shank including an anchor cable attachment point and control or restraint mechanisms whereby the shank can be set such that the cable attachment point can lie selectively in first, second, and third directions relative to the fluke centroid, the directions providing three fluke centroid angles ($\alpha$, $\beta$, and $\theta$, respectively) with the fluke forward direction (F). The Denla is part of an anchoring apparatus including a rear drogue line serving to orientate the anchor correctly at the sea bed without the need for a separate pendant line. In operation, the Denla is embedded by pulling on an anchor cable with the first fluke centroid angle $\alpha$ present; when the desired horizontal anchor loading is achieved, the shank is moved to the second larger centroid angle $\beta$ and the anchor swung back until the fluke forward direction (F) is inclined upwardly, this position constituting the normal load anchoring position. For Denla retrieval, the shank is swung forwardly to occupy the smaller third fluke centroid angle $\theta$, and the anchor pulled upwardly in the included fluke forward direction (F). The restraint/control mechanisms are preferably located in a grease filled housing for protection and a further fluke centroid angle lower than the first centroid angle can be provided for the shank to ensure satisfactory initial burying of the anchor. The invention enables setting of the Denla and also retrieval using a single line, i.e., the anchor line.

29 Claims, 13 Drawing Sheets

ANCHORING APPARATUS AND METHOD

The present invention relates to drag embedment marine anchors and to a type of anchor adapted for loading normal to the anchor fluke after installation.

An anchor of the said type is disclosed in the present inventor's application PCT/GB92/02210 entitled "Drag Embedment Marine Anchor" and comprises a fluke and a shank means attached to the fluke and arranged to provide at least one attachment point for attachment of an anchor cable, said shank means being adapted such that the anchor provides two directions from the centroid of the fluke to said attachment point whereby, in relation to the forward direction of the fluke measured in a fore-and-aft plane of symmetry of the anchor, a first direction forms a first forward-opening angle with said forward direction and a second direction forms a second forward-opening angle with said forward direction greater than said first forward-opening angle whereby a first pulling action on the anchor at an attachment point located in said first direction permits drag embedment of the anchor by movement substantially in said forward direction in the soil whilst a subsequent pulling action on the embedded anchor at an attachment point in said second direction substantially transverse to said forward direction precludes such movement, the projected area of the fluke in said second direction being greater than the projected area of the fluke in said first direction so that a greater resistance to movement of the anchor is present for said subsequent pulling action than for said first pulling action. Since an anchor of this type may be described as a Drag Embedment Normal Load Anchor, the acronym Denla will be used hereinafter to denote an anchor of the type described hereinbefore.

Hitherto a Denla has been installed in shallow water by means of two lines: the anchor line and an auxiliary pendant line attached to the rear of the fluke to control the heading of the Denla and remotely activate its triggering mechanism. Recovery after use has been effected by heaving up on the pendant line to rotate the Denla in the soil and then pull it to the sea bed surface against low resistance loads engendered by edge-wise rearwards movement of the fluke. However, in deep water installations necessitating long lines, it is possible for the two lines to become twisted together whereby control is lost of the heading of the Denla thus preventing successful deployment.

It is an object of the present invention to provide anchoring apparatus capable of being installed and subsequently easily recovered by means of an anchor line without recourse to an auxiliary pendant line.

Another object of the present invention is to provide a method of installing and recovering said anchoring apparatus.

According to a first aspect of the present invention, an anchoring apparatus for drag embedment in a submerged soil by means of an anchor cable comprises an anchor and a drogue line attached to a rear portion thereof which hangs vertically as the anchor is lowered proximal to the sea bed surface while suspended by the anchor cable whereby, when the apparatus is moved horizontally with a portion of the drogue line dragging in contact with the sea bed surface, a horizontal motional resistance force is produced by the drogue line which is equal and opposite to the horizontal component of force in the anchor cable and in aligning therewith acts to constrain the suspended anchor to point only in the direction of dragging motion.

Preferably said drogue line is attached to an aftermost point on the anchor.

Preferably an end of said drogue line remote from said anchor includes a resistive element capable of providing considerable motional resistance when dragged in contact with the sea bed surface.

Preferably said resistive element comprises a length of heavy chain.

Preferably the length of said drogue line is between 1.5 and 4 times the length of the fluke of the anchor.

According to a second aspect of the present invention, an anchoring apparatus for drag embedment in a submerged soil by means of an anchor cable includes a Denla characterised in that three directions from the centroid of the fluke to the anchor cable attachment point are provided with the third direction forming a third forward-opening angle with the forward direction of the fluke smaller than the second forward-opening angle and first, second, and third restraint means are provided to maintain the anchor cable at said attachment point in first, second, and third directions respectively whereby, following rotation of the embedded Denla due to pulling the anchor cable upwards and backwards at the attachment point lying in the second direction to cause the fluke forward direction to become inclined upwards, further pulling of the anchor cable forwards and upwards at the attachment point lying in said third direction causes the Denla to move during recovery to the sea bed surface substantially in the now upwardly inclined forward direction of the fluke with consequent low edge-wise motional resistance of the fluke in the soil.

Preferably said second forward-opening angle lies in the range 84° to 96° with 90° further preferred.

Preferably said third forward-opening angle does not exceed 43° and, further preferably, does not exceed 36°.

Preferably the shank means comprises an elongate rigid shank member with an anchor cable attachment point at one end and pivotably connected at the other end to the fluke by a pivot pin in the region of the centroid of the fluke, said shank member being pivotable between first, second, and third restraint means whereby a straight line containing the fluke centroid and the cable attachment point may successively occupy the first, second, and third directions provided.

Preferably the first restraint means is remotely releasable and comprises a shearable pin between shank member and fluke which locks the shank member to the fluke and prevents it from pivoting until a predetermined value of moment of force in the anchor cable about the pivot pin is applied which shears the shearable pin.

Preferably the second restraint means comprises a rigid stop member attached to one of the fluke and shank member which by one-way arrestment limits backwards pivoting of the shank member.

Preferably the third restraint means comprises a latch mechanism which locks the shank member to the fluke following forward pivoting of the shank member from contact with the rigid stop member.

Preferably the latch mechanism comprises a spring-loaded bolt mounted on one of the fluke and the shank member which is engageable in a mating hole in a plate member rigidly attached to the other one of the fluke and the shank member.

Preferably a drogue line is attached to and streamable from a rear portion of the fluke, said drogue line being chosen in size to produce a drag force due to soil friction when embedded sufficient to induce forward pivoting of the shank member relative to the fluke when movement of the Denla in the soil is caused by pulling on the attached anchor cable.

Preferably the drogue attached to the rear of the fluke comprises a length of wire rope connected to and followed by a length of heavy chain.

Preferably the length of said drogue line is between 1.5 and 4 times the length of the fluke.

According to a third aspect of the present invention a method for installing and recovering an anchoring apparatus including an anchor and an attached drogue line comprises the following steps:

INSTALLING (a) lower the apparatus by means of the anchor cable towards the sea bed surface until an end portion only of the drogue line attached to the suspended anchor rests on the sea bed surface;

(b) move the apparatus horizontally to allow motional resistance forces on the drogue line to turn the anchor about the axis of the anchor cable to point in the direction of horizontal movement;

(c) recommence lowering the apparatus while simultaneously moving it horizontally to bring the anchor fluke into contact with the sea bed surface with the fluke pointing in the direction of movement;

(d) lay out a sufficiently long scope of anchor cable to permit effective drag embedment of the anchor;

(e) pull on the laid out anchor cable at long scope to trip and embed the anchor into the sea bed until the required horizontal capacity has been achieved;

RECOVERING (f) heave up vertically on the anchor cable to rotate the anchor in the sea bed soil to incline the fluke forward direction upwards towards the sea bed surface;

(g) continue heaving to move the anchor along the inclined direction of the fluke to the sea bed surface and ultimate recovery from the water.

According to a fourth aspect of the present invention, a method for installing and recovering an anchoring apparatus including a Denla and an attached drogue line comprises the following steps:

INSTALLING (a) lower the apparatus by means of the anchor cable towards the sea bed surface until an end portion only of the drogue line attached to the suspended Denla rests on the sea bed surface;

(b) move the apparatus horizontally away from the position of the vessel to be moored to allow motional resistance forces on the drogue line to turn the Denla about the axis of the anchor cable point in the direction of horizontal movement;

(c) recommence lowering the apparatus while simultaneously moving it horizontally away from the position of the vessel to be moored to bring the Denla fluke into contact with the sea bed surface with the fluke pointing in the direction of movement;

(d) lay out a sufficiently long scope of anchor cable to permit effective drag embedment of the Denla;

(e) pull on the laid out anchor cable at long scope to trip and embed the Denla into the sea bed until the required horizontal capacity has been achieved with the cable attachment point located in the first direction;

(f) heave in the laid out anchor cable and pull up vertically over the embedded Denla to bring the cable attachment point into the second direction; if desired, the normal load capacity of the Denla may now be tested by heaving up on the anchor cable until a chosen test load is achieved;

(g) lay out anchor cable in the direction of the vessel to be moored and pull on it to cause the Denla to be rotated backwards until the fluke becomes substantially normal to the direction of pull applied at the anchor cable attachment point and the fluke forward direction is inclined upwards ready for mooring service and subsequent recovery;

RECOVERING (h) pick up the anchor cable and, from a position on the far side of the embedded Denla from the position of the vessel that had been moored, pull forwards and upwards on it to bring the cable attachment point into the third direction for Denla recovery;

(k) continue heaving to move the Denla along the inclined direction of the fluke to the sea bed surface and ultimate recovery from the water.

Embodiments of the present invention will now be described by way of example with reference to the accompanying drawings wherein:

FIG. 1 shows a marine anchoring apparatus in elevational view in accordance with the present invention; while

Figure 1:
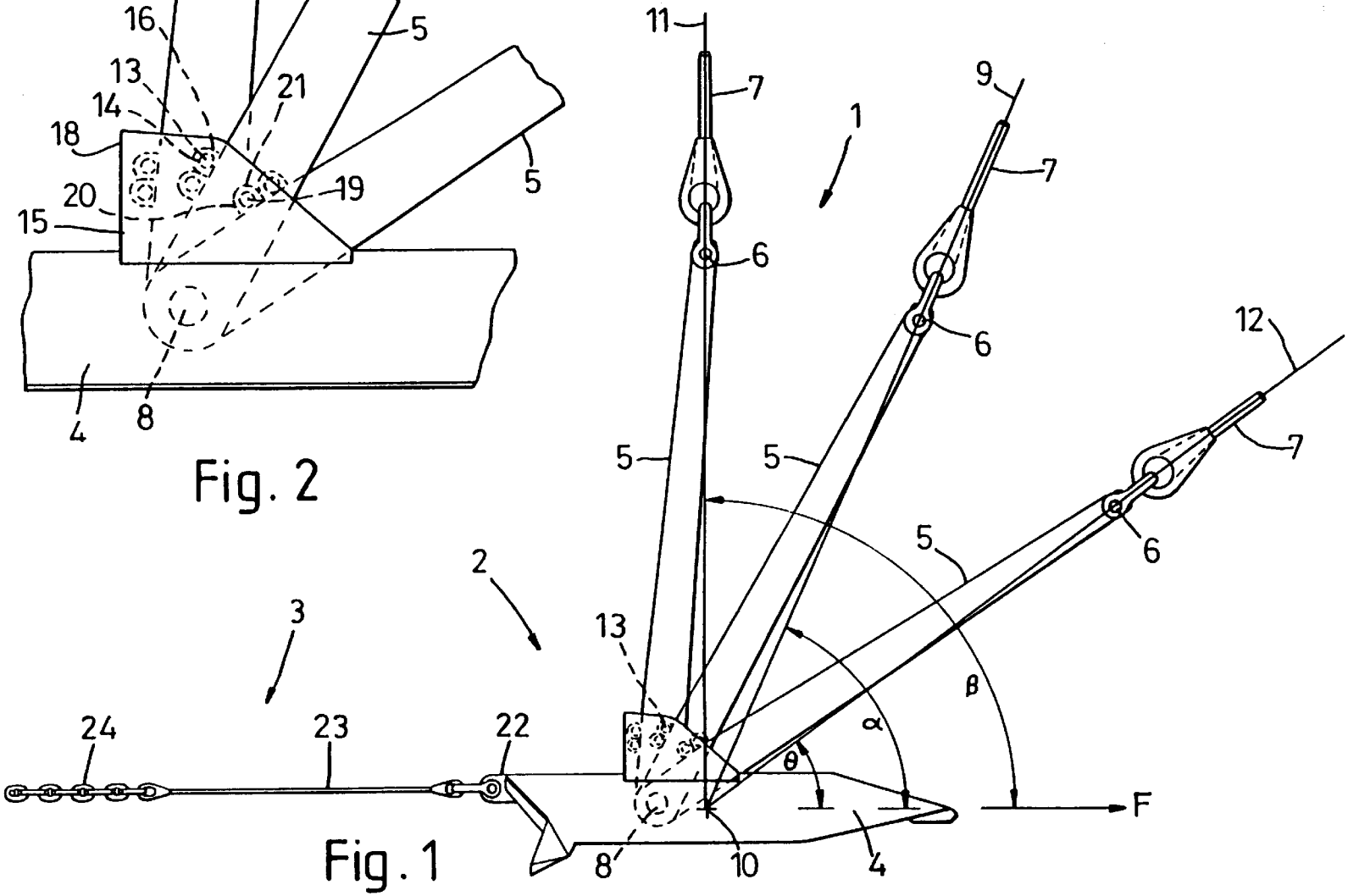

The anchoring apparatus 1 shown in FIG. 1 includes a Denla 2 connected to a drogue line 3. The Denla 2 is generally in accordance with the pivoting shank anchor described as one inventive embodiment in the present applicant's International publication W093/11028(PCT/GB92/02210). Thus the Denla 2 is of slim streamlined form to encourage deep burial of the Denla 2 in submerged soils and comprises an anhedral-form plate-like fluke 4 connected to one end of a shank 5, the other end of the shank 5 including a shackle hole 6 for attachment of an anchor cable 7. The shank 5 is pivotally connected to the fluke 4 at a pivot-point 8 whereby the shank 5 can pivot to move the shackle hole 6 from lying on a first direction line 9 extending through the fluke centroid 10 to lie on a second direction line 11 extending through the centroid 10 and also pivot to move the shackle hole 6 from lying in second direction line 11 to lie on a third direction line 12 extending through the centroid 10. The first direction line 9 forms a centroid fluke angle ($\alpha$) with a forward direction F of fluke 4 while the second direction line 11 forms a centroid fluke angle ($\beta$) with forward direction F and the third direction line 12 forms a centroid fluke angle ($\theta$) with forward direction F. Forward direction F is parallel to the intercept line of two planes containing the upper anhedral surfaces of fluke 4. Angle ($\beta$) is greater than angle ($\alpha$) and is in the range 84° to 96° but generally will be chosen to approximate to 90°. Angle ($\alpha$) is in the range 55° to 72° for operation in soft clay soils, but generally will be chosen to approximate to 66°; and angle ($\alpha$) is in the range of 39° to 46° for operation in sands, but generally will be chosen to approximate to 43°. Angle ($\theta$) is smaller than angle ($\alpha$) for soft clay soils and is less than 43° and generally will be chosen to be not greater than 36°.

Figure 2:
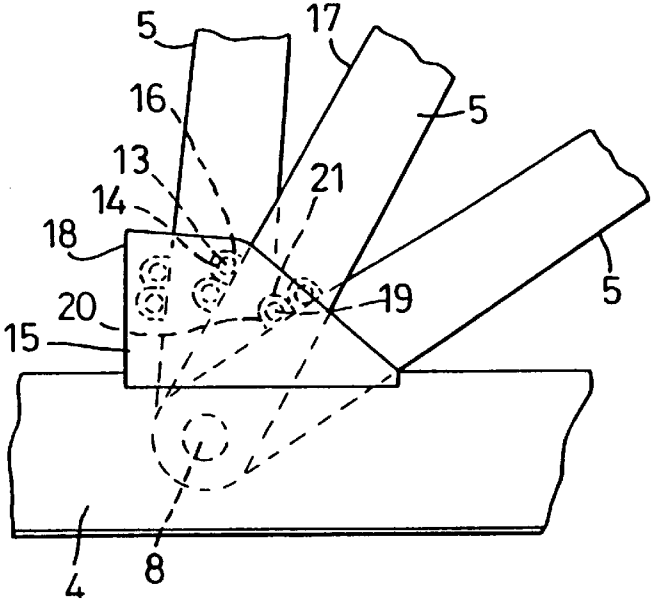
FIG. 2 shows an enlarged detail of a portion of the apparatus of FIG. 1.

Again a first restraint is present (see detail in FIG. 2) by way of a shear pin 13 located in holes 14 in shank stop support plates 15 rigidly attached to fluke 4 at each side of the pivotable shank 5 and located in housing 16 rigidly attached to the rear face 17 of shank 5. Shear pin 13 serves to restrain shank 5 and hold hole 6 in direction line 9 (FIG. 1).

Fracturing of shear pin 13 by pulling backwards on the shank 5 via the anchor cable 7 when the fluke 4 is in the restrained buried condition frees the shank 4 to pivot freely back to bring hole 6 onto direction line 11.

The second restraint in the form of shank stop 18 fixed between shank stop support plates 15, which engages with rear face 17 of shank 5, limits backward pivoting of shank 5. Thus, the anchor cable 7 itself serves as the remote control means for releasing the first restraint means and the separate pendant cable previously used, inter alia, for this function is now dispensed with.

An additional feature of the present Denla 2 is that the shank 5 can be locked relative to the fluke 4 by a third restraint means when shank 4 is pivoted forward from contact with shank stop 18 by pulling forward on anchor cable 7.

The third restraint means comprises two spring bolts 19 mounted inside a tubular housing 20 attached to the rear face 17 of shank 5 which spring out and engage in mating bolt holes 21 in shank stop support plates 15 when hole 6 in shank 5 is lying in direction line 12. The centroid fluke angle (θ) is now set at approximately 36° which facilitates recovering the Denla 2 as will be explained later.

A rear shackle lug 22 on fluke 4 serves for the fitting of drogue line 3 which has a length between 1.5 and 4 times the length of fluke 4. Drogue line 3 comprises a length of wire rope 23 shackled to lug 22 at one end and attached at another end to a short length of heavy chain 24. The drogue line functions to orientate the heading of the Denla 2 as it approaches the sea bottom and to assist in pivoting shank 5 to bring hole 6 from direction line 11 to direction line 12 as will be explained later.

The Denla 2 can also be configured to act as a conventional single-sided fixed-fluke mooring anchor by using a shear pin 13 sufficiently strong to resist shank pivoting forces arising when deployed conventionally. In this case, drogue 3 serves solely to orient the heading of the anchor as it approaches the sea bottom.

A preferred first method of installing and recovering the Denla 2 followed, for comparison, by a preferred second method of installing and recovering it when acting as a conventional single-sided fixed-fluke mooring anchor will now be described with reference to FIGS. 3 to 10. A significant feature of both methods is that a single anchor cable only is required to perform all necessary operations for installation and recovery in deep water where conventional use of an anchor cable and an auxiliary pendant line gives rise to uncertainty due to the high likelihood of twisting together of the anchor cable and pendant line when extremely long.

Figure 3:
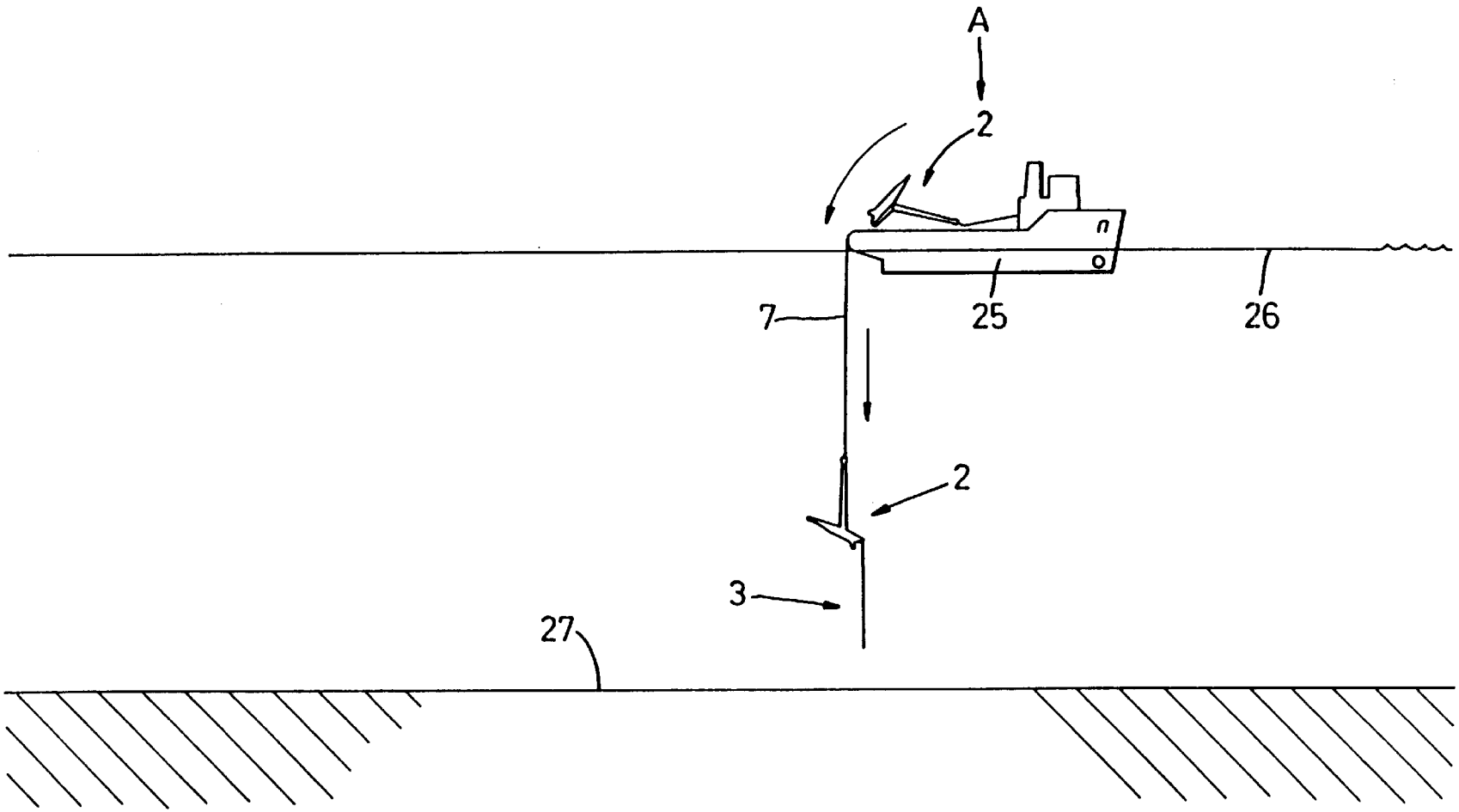
FIGS. 3 to 10 show the steps in a method for installing and recovering anchoring apparatus in accordance with the present invention.
Figure 4:
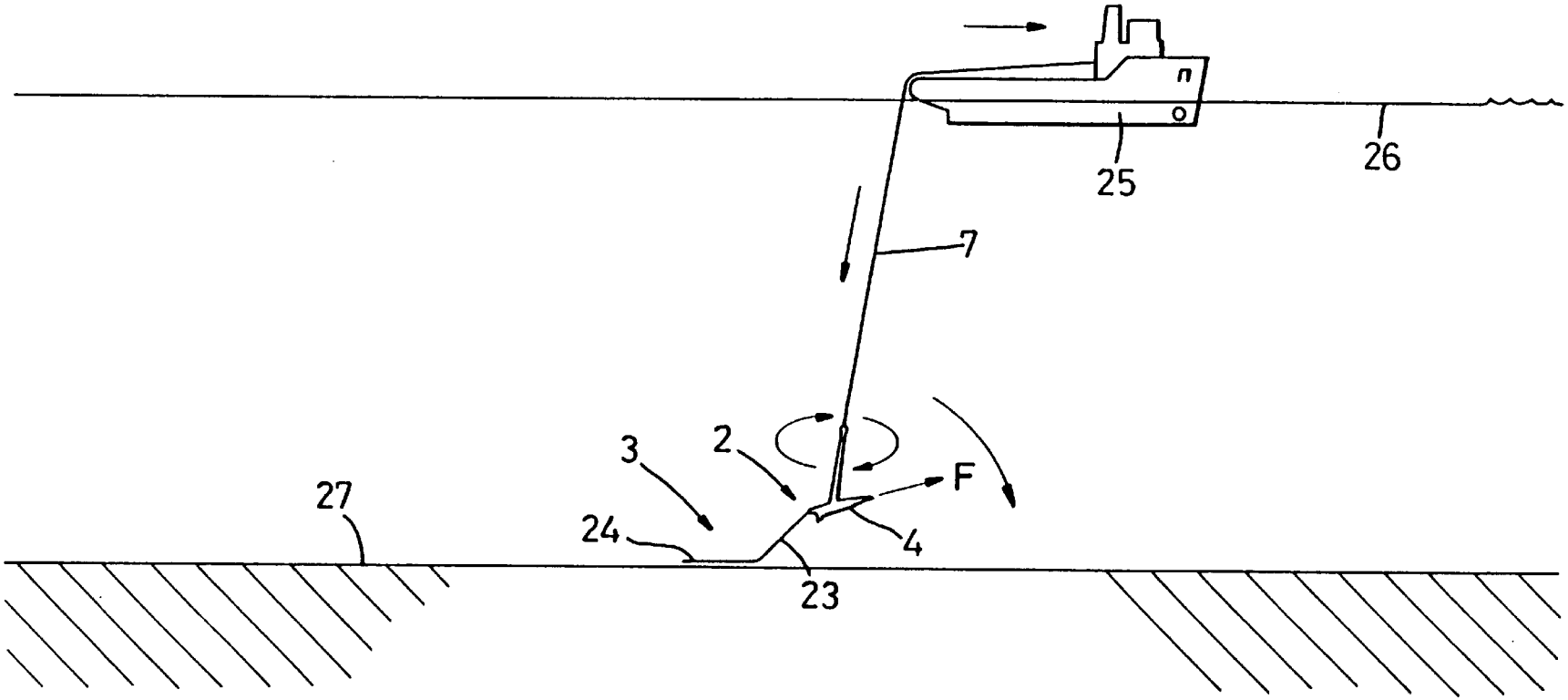

Referring to FIGS. 3 to 10, in the Denla 2 method, an anchor handling vessel (AHV) 25 floating on sea surface 26 and carrying Denla 2 lowers the Denla 2 towards the sea bed surface 27 (FIG. 3) by paying out the anchor cable 7 while over a position near the desired set-down point for Denla 2 (between the set-down point and the position A of the vessel or object to be moored)until contact with the sea bed surface 27 is first made by the drogue line 3 (FIG. 4) and chain 24 is laid out on the sea bed surface with the Denla 2 remaining suspended above sea bed surface 27. The AHV 25 now commences to move slowly away from the position A whilst simultaneously recommencing to pay out anchor cable 7 slowly. Motional resistance forces on chain 24 are transmitted to suspended Denla 2 via wire rope 23 of drogue line 3 causing it to rotate about the axis of anchor cable 7 so that the forward direction F of fluke 4 is turned to the same heading as AHV 25, as shown in FIG. 4.

The speeds of the AHV 25 and the paying out of anchor cable 7 are regulated to bring fluke 4 into contact with sea bed surface 27 at the desired touch-down point whereupon the paying out speed is made equal to the speed ahead of AHV 25 until a sufficiently long scope of anchor cable has been laid out to permit drag embedment of Denla 2 without significant uplift occurring in anchor cable 7 at sea bed surface 27 in the process.

The AHV 25 now pulls on anchor cable 7 (FIG. 5) to trip Denla 2 to bring both fluke 4 and shank 5 into contact with sea bed surface 27 and then commences pulling progressively harder to drag embed Denla 2 along a curved trajectory track 28 in sea bed soil 29 with drogue line 3 streaming behind fluke 4 in trajectory track 28 until a desired horizontal component of load in anchor cable 7 has been reached.

Figure 6:
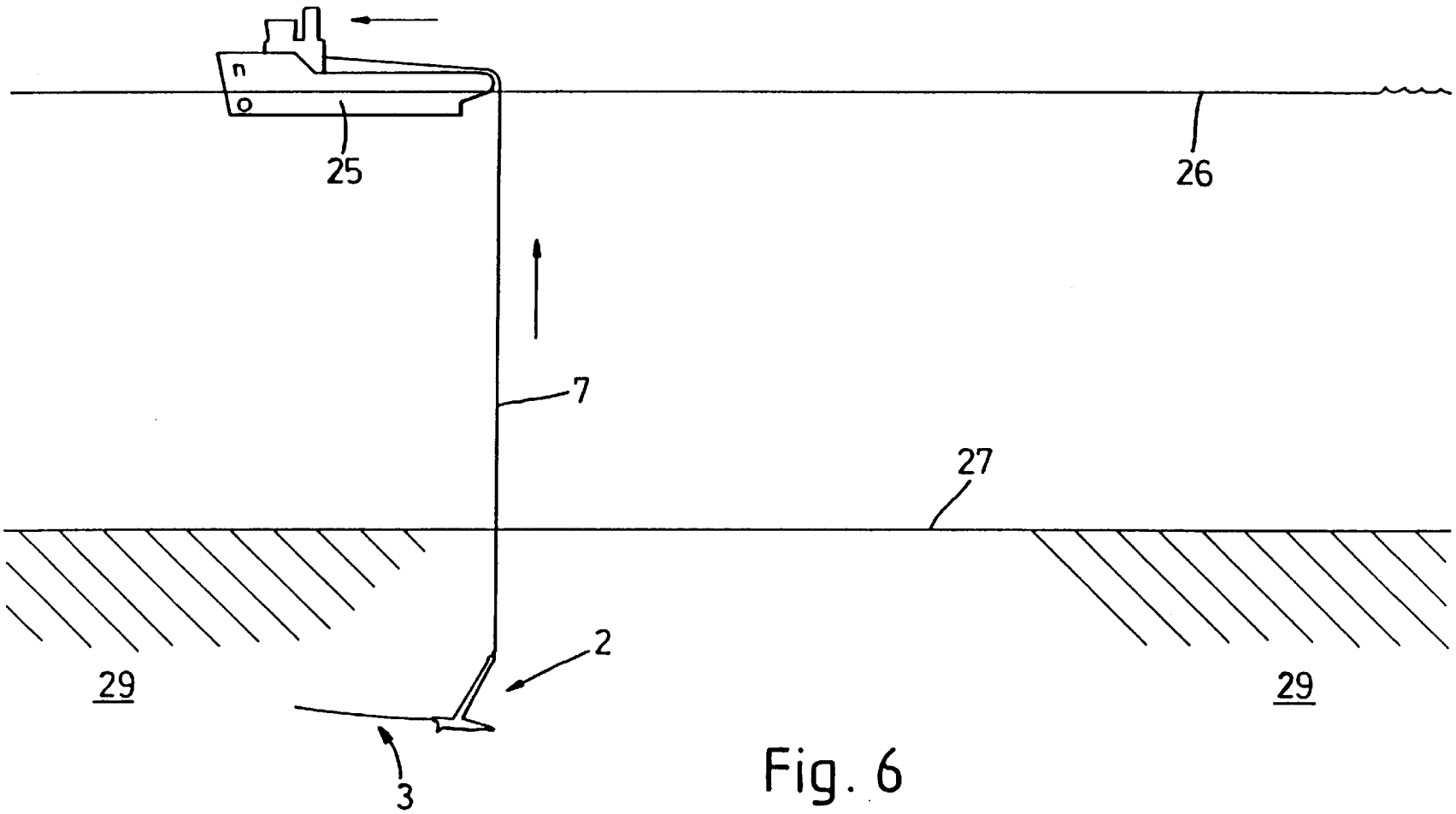
Figure 7:
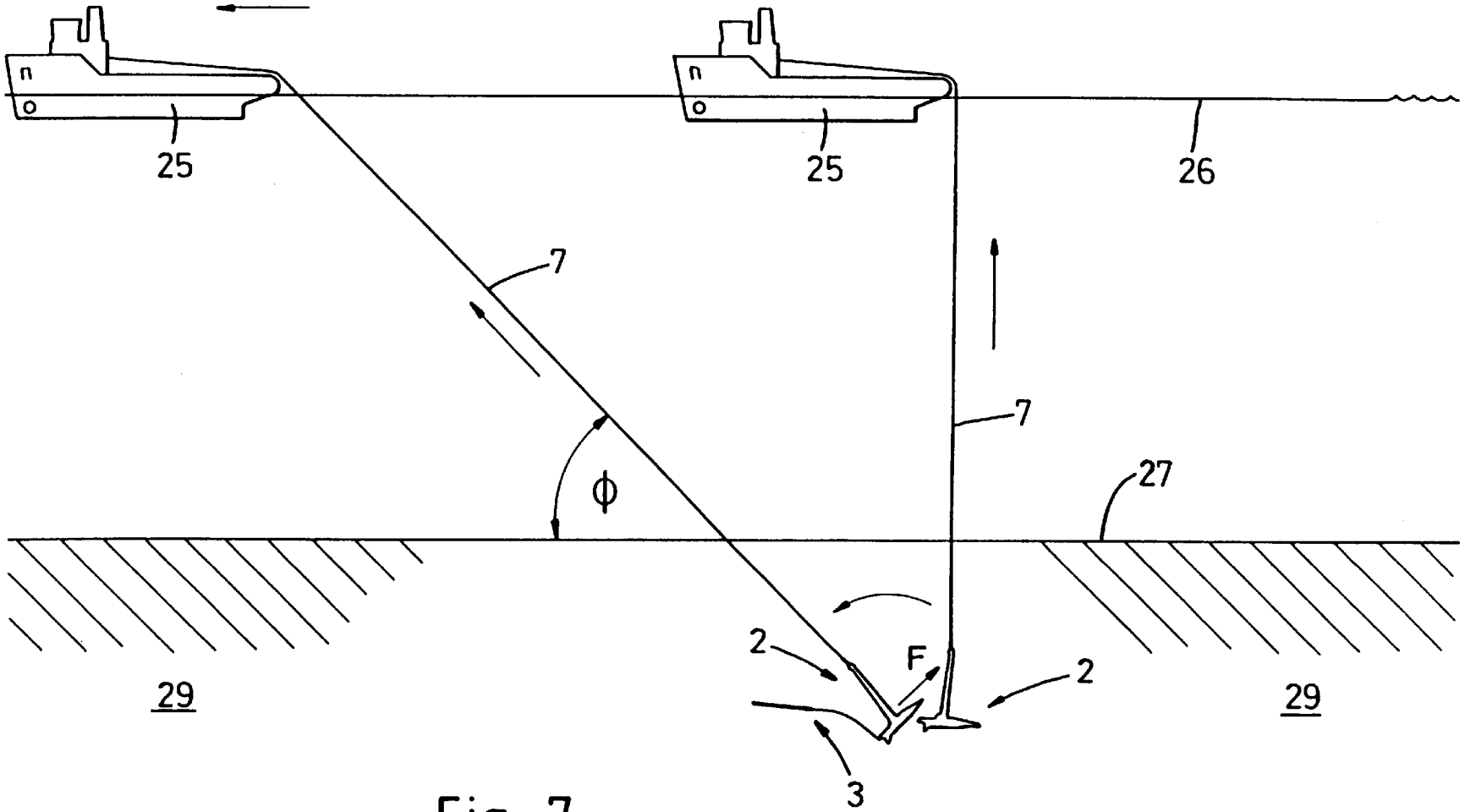

Referring to FIG. 6, the AHV 25 is now turned 180° in heading and moves back over the Denla 2 as it heaves in anchor cable 7 until anchor cable 7 becomes vertical. Further heaving (FIG. 7) on anchor cable 7 causes the shear pin 13 of the first restraint means to break thereby freeing the shank 5 which pivots backwardly into contact with shank stop 18 thus bringing the direction of load in anchor cable 7 substantially normal to fluke 4 at centroid 10. Confirmation of the holding capacity of the now triggered (on second restraint) Denla 2 may be obtained by applying a desired testing load vertically by means of anchor cable 7.

Figure 8:
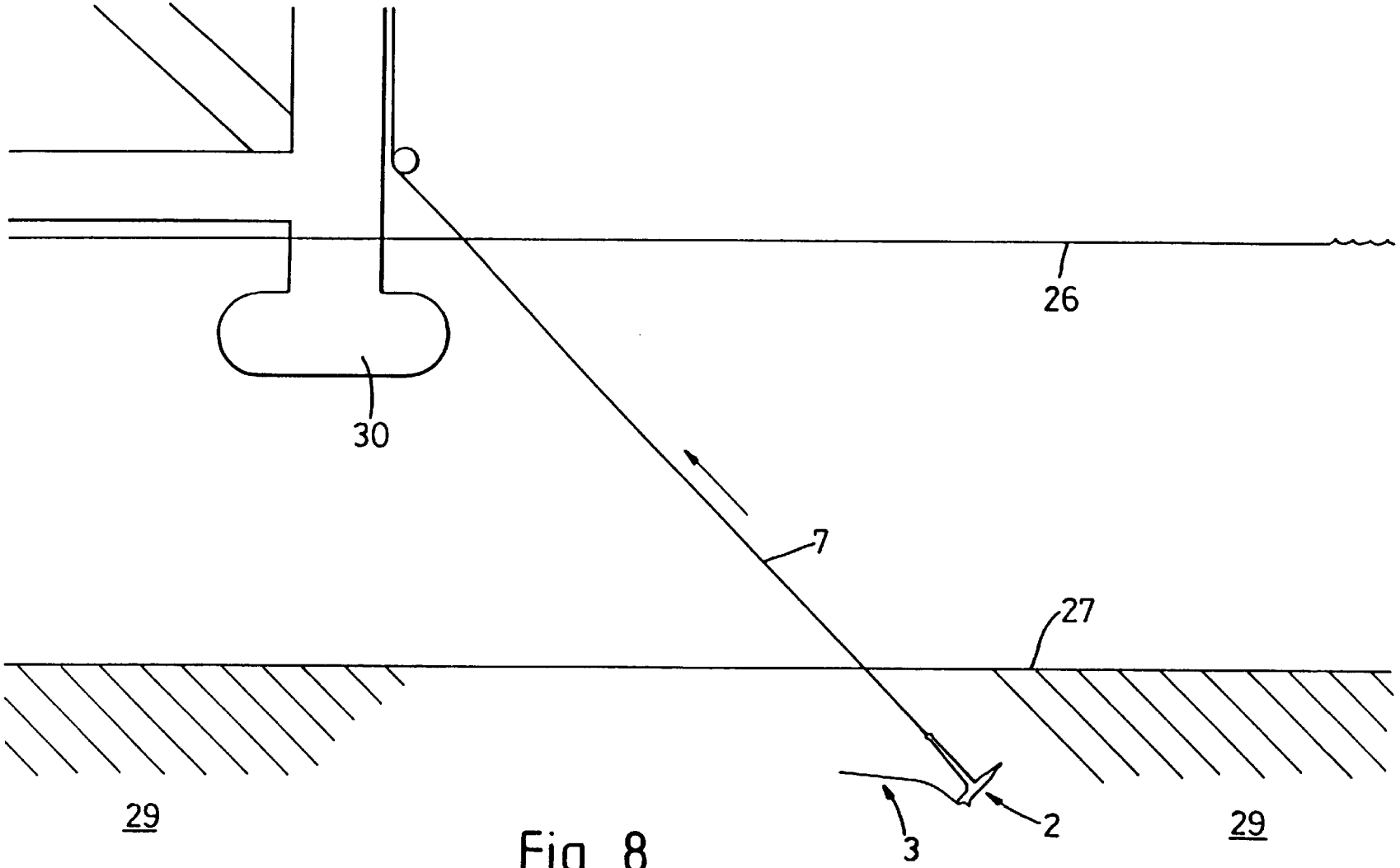
Figure 9:
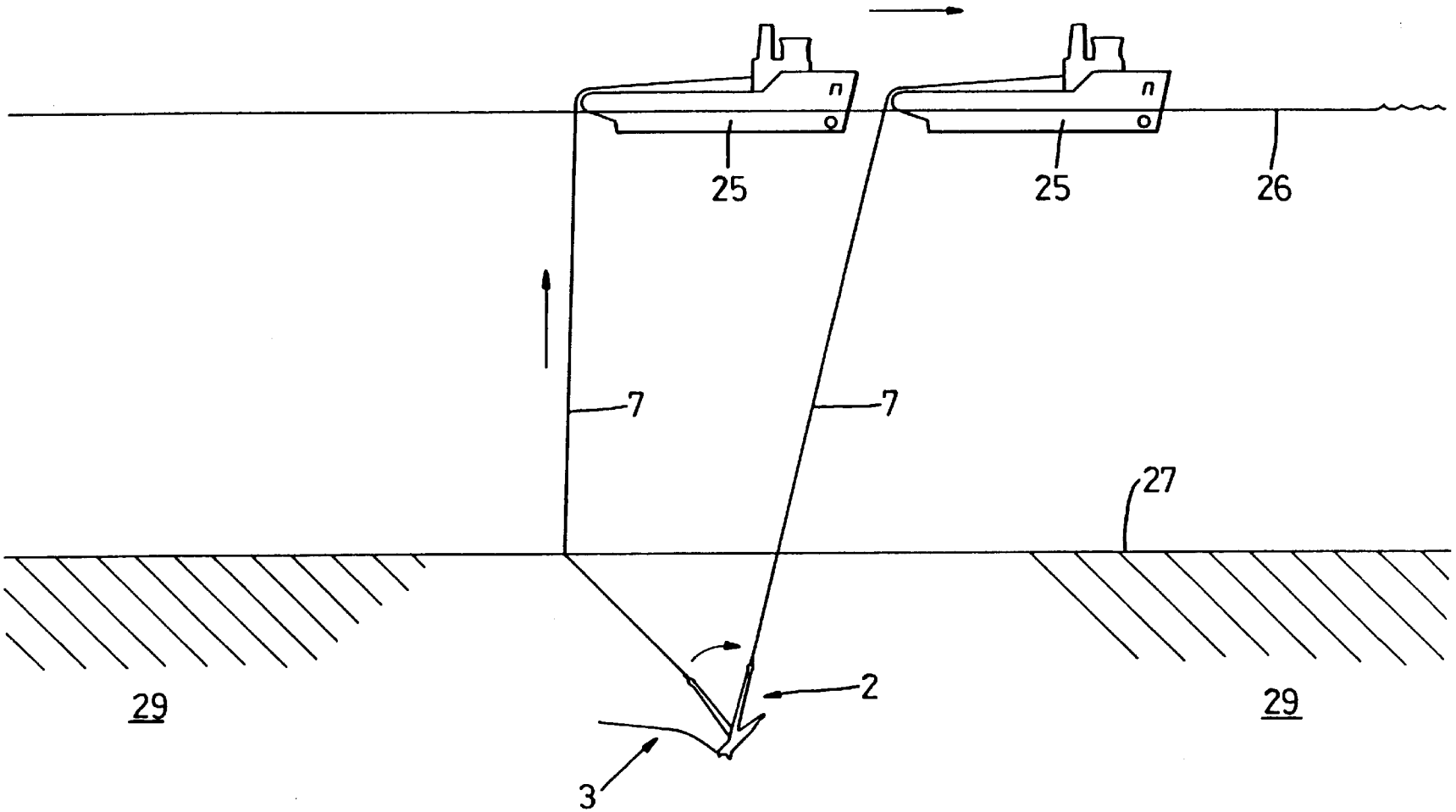
Figure 10:
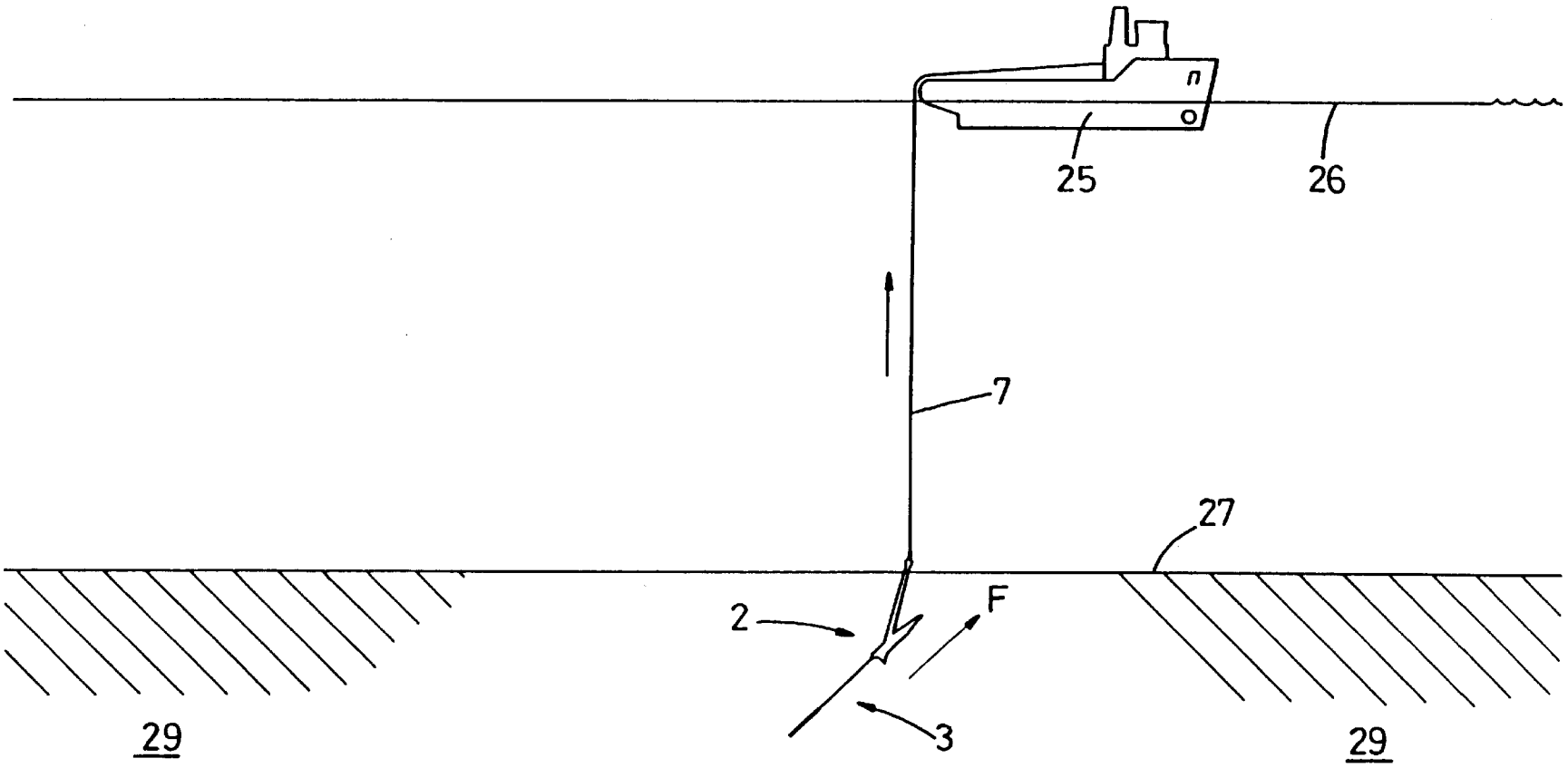

The AHV 25 then steams ahead to cause Denla 2 to rotate in sea bed soil 29 due to the leverage of shank 5 bearing on shank stop 18 until the Denla 2 achieves a backwards orientation with the forward direction F of fluke 4 inclined upwards ready for mooring service and subsequent recovery and also the desired uplift angle (ϕ) of anchor cable 7 at the sea bed surface 27, which may be as high as 45° for a taut mooring system, has been established. The anchor cable 7 is now passed over to the vessel 30 to be moored and connected thereto as shown in FIG. 8. Vessel 30 winches in anchor cable 7 and may apply a further test load at uplift angle (ϕ). The fluke 4 of Denla 2 is already keyed into the normal load position to provide the required resistive load for vessel 30 which, most likely, will be restrained in its position by a spread of Denlas 2 deployed around it.

When the vessel 30 departs from location, anchor cable 7 will be buoyed off and the Denla 2 can be recovered simply as follows.

The AHV 25 (FIG. 9) picks up the anchor cable 7 and heaves up on it while steaming ahead to pivot shank 5 from contact with shank stop 18 forwardly until spring bolts 19 of the third restraint means engage in mating bolt holes 21 to lock shank 5 with hole 6 positioned in direction line 12 to establish a fluke centroid angle (θ) equal to 36°.

Any upward movement of Denla 2 during this operation causes soil friction forces on drogue line 3 to arise which act to assist the heaving force in anchor cable 7 to cause pivoting of shank 5 relative to fluke 4. The AHV 25 (FIG. 10) then heaves vertically on anchor cable 7 to pull the Denla 2 substantially in fluke direction F to the sea bed surface 27 for breaking out and recovery on deck. The small centroid fluke angle of 36° minimises recovery resistance forces which may typically be less than half of the horizontal load required to embed the untriggered Denla 2. The combination of the drogue line 3 with the shear pin 13 remotely releasable first restraint and the spring-bolt remotely engageable third restraint renders this method possible when using only one operating line, anchor cable 7, attached to Denla 2.

Figure 5:
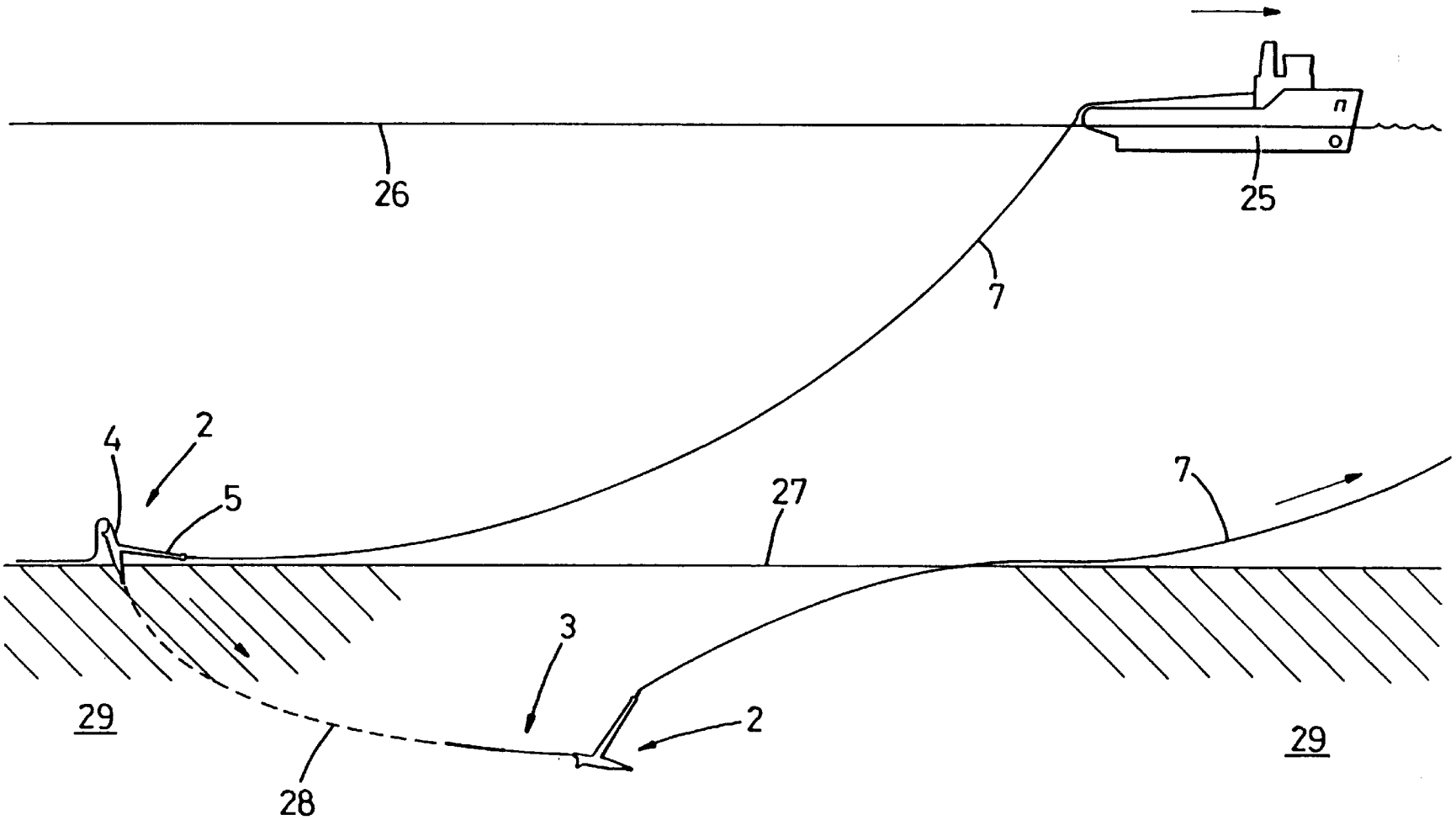

In the method for installing and recovering the Denla 2 when it is configured to act as a conventional one-sided fixed-fluke mooring anchor (hereinafter referred to simply as "anchor 2"), the steps previously described and shown in FIGS. 3 to 5 are followed except that anchor 2 is embedded by pulling anchor 2 towards the position of the vessel to be moored instead of away from it. Following complete embedment, the capacity of anchor 2 is tested horizontally by pulling on anchor cable 7 with the AHV 25 before connecting anchor cable 7 to the vessel to be moored. However, the maximum capacity achievable by the anchor 2 will be considerably less than half the capacity achievable by the Denla 2.

After the moored vessel has departed, recovery of anchor 2 is effected by the AHV 25 picking up anchor cable 7 and heaving vertically over anchor 2 as shown in FIG. 6 to rotate anchor 2 in the sea bed soil 29, to incline the fluke forward direction F upwards, and then pulling anchor 2 to the sea bed surface 27 (FIG.10) for breaking out albeit at a larger centroid fluke angle (β) of 66° instead of 36° for Denla 2. In this case, much higher breaking out forces are encountered which may exceed the maximum horizontal loads occurring during drag embedment and subsequent test loading of anchor 2.

FIGS. 11A to 11D show a side view of a modified Denla anchor in accordance with a further embodiment of the present invention. A principal aim of this further embodiment is to ensure to a greater degree fool proof working of the anchor in the inhospitable environment of the sea bed. However like parts to those of the previous embodiment carry like reference numbers.

Thus the restraint and control means for the setting of the shank 5 are now housed in a substantially enclosed housing 40 while the shank 5 carries a quadrant plate 41 which extends into the housing 40 through an open side slot 42A. The plate 41 however has a close clearance with the side walls 42 of the housing 40 so that slot 42A is essentially closed, the only real openings from the housing 40 being via apertures 43, 44. An additional feature is the provision of a preliminary control comprising a very light shear pin 45 which engages in a groove 46 of the quadrant 41 to set the shank 5 at a much lower preliminary control angle than angle α: this avoids any risk of the Denla 2 being pulled onto its back on initial pulling on the anchor cable 7 as may happen with the much higher set shank angle α. Further the shank 5 is set for angle θ by means of a controlled pawl mechanism 47 engaging a series of detents 19A, 19B, the mechanism 47 including springs 48, 49, with the much higher set shank angle α. Further the shank 5 is set for angle θ by means of a controlled pawl mechanism 47 engaging a series of detents 19A, 19B, the mechanism 47 including springs 48, 49.

To prevent ingress of grit and other solid soil particles into the housing 40 to endanger effective operations of the restraint control elements, especially the mechanism 47, the housing 40 is packed with grease.

The pawl mechanism 47 comprises a pawl 50 carried by shaft 51 journalled to the side plates 42, spring 48 engaging a pawl arm 52 to urge the pawl 50 clockwise (arrow c). However, a swinging stop plate 53 biassed by spring 49 arrests the pawl 50 via detent 54. The shaft 51 makes substantial surface contact (part cylindrical) with a step 55 on the housing 40 so that the pawl 50 can withstand substantial loading.

Figure 11A:
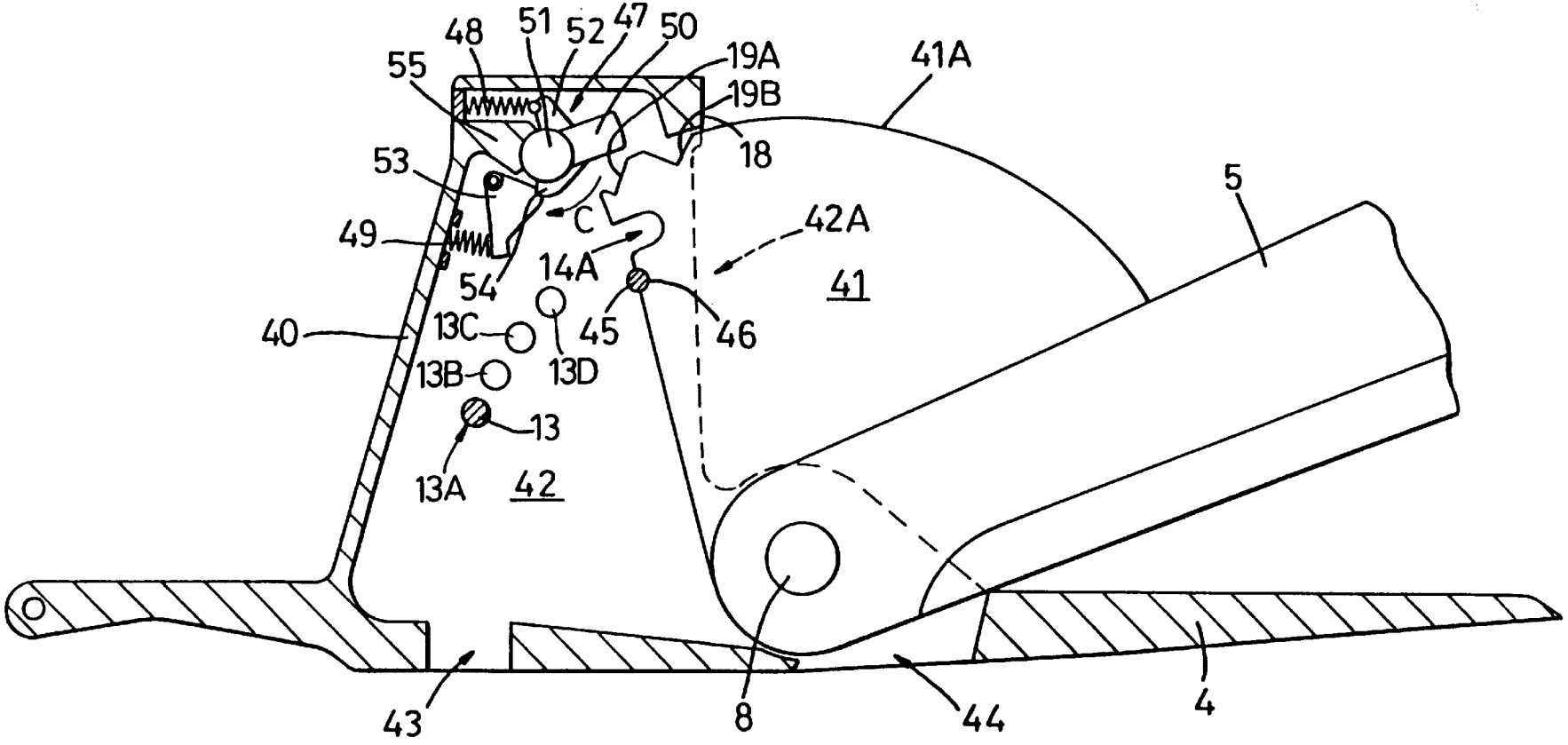
FIGS. 11A to 11D show a further embodiment of the invention.
Figure 11B:
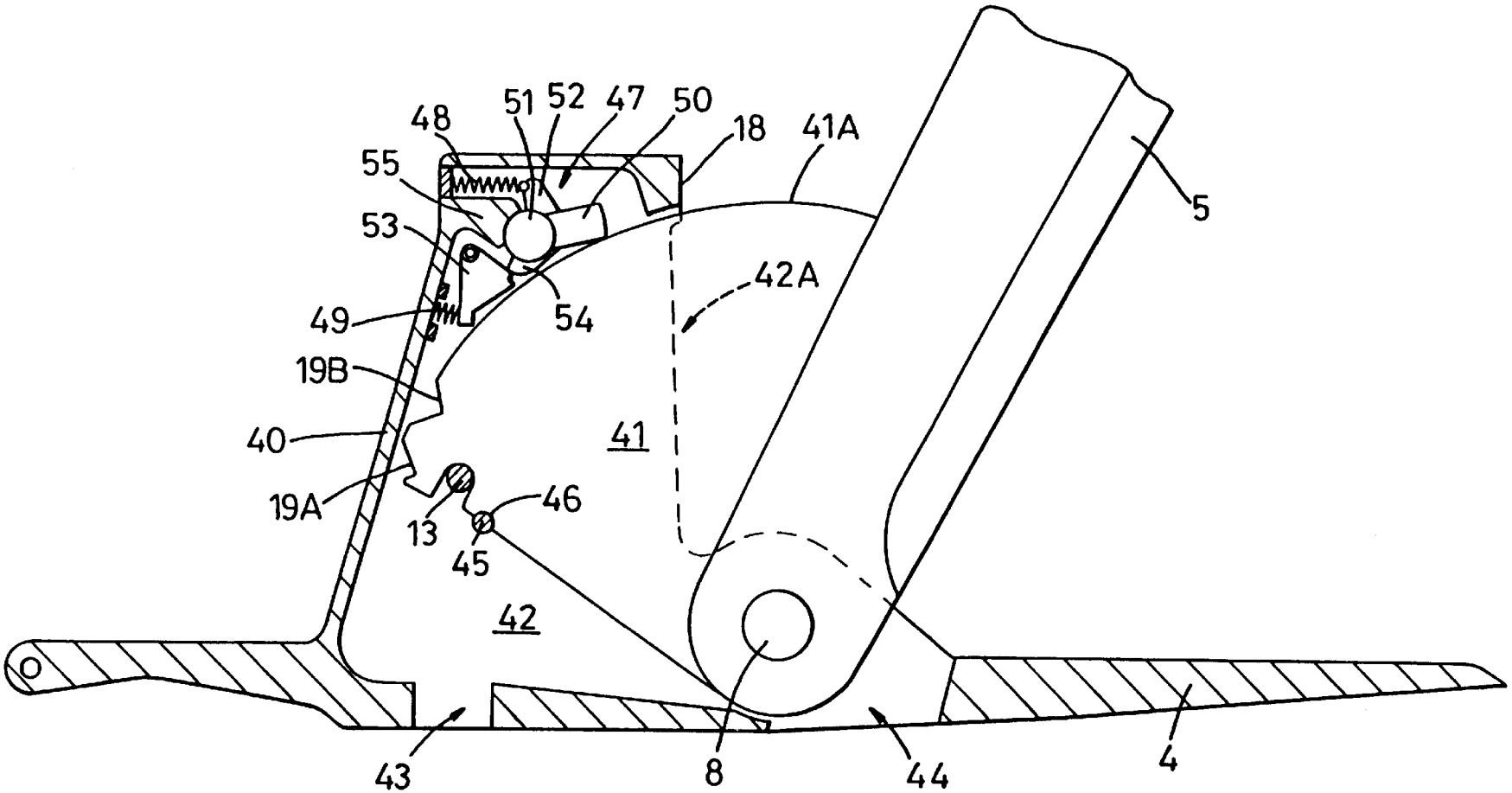

In operation of this embodiment, the Denla 2, will engage the sea bed surface for drag embedment as shown in FIG. 3 but initially set as shown in fig 11A. However on pulling on anchor line 7 to cause initial fluke penetration a small load is soon generated sufficient to fracture shear pin 45 and the shank 5 can be swung back until groove 14A engages pin 13 located in hole 13A as shown in FIG. 11B for the normal fluke setting (fluke centroid angle). Additional holes 13B, 13C, 13D enable different settings of the shear pin 13 for different fluke centroid angles α.

Figure 11C:
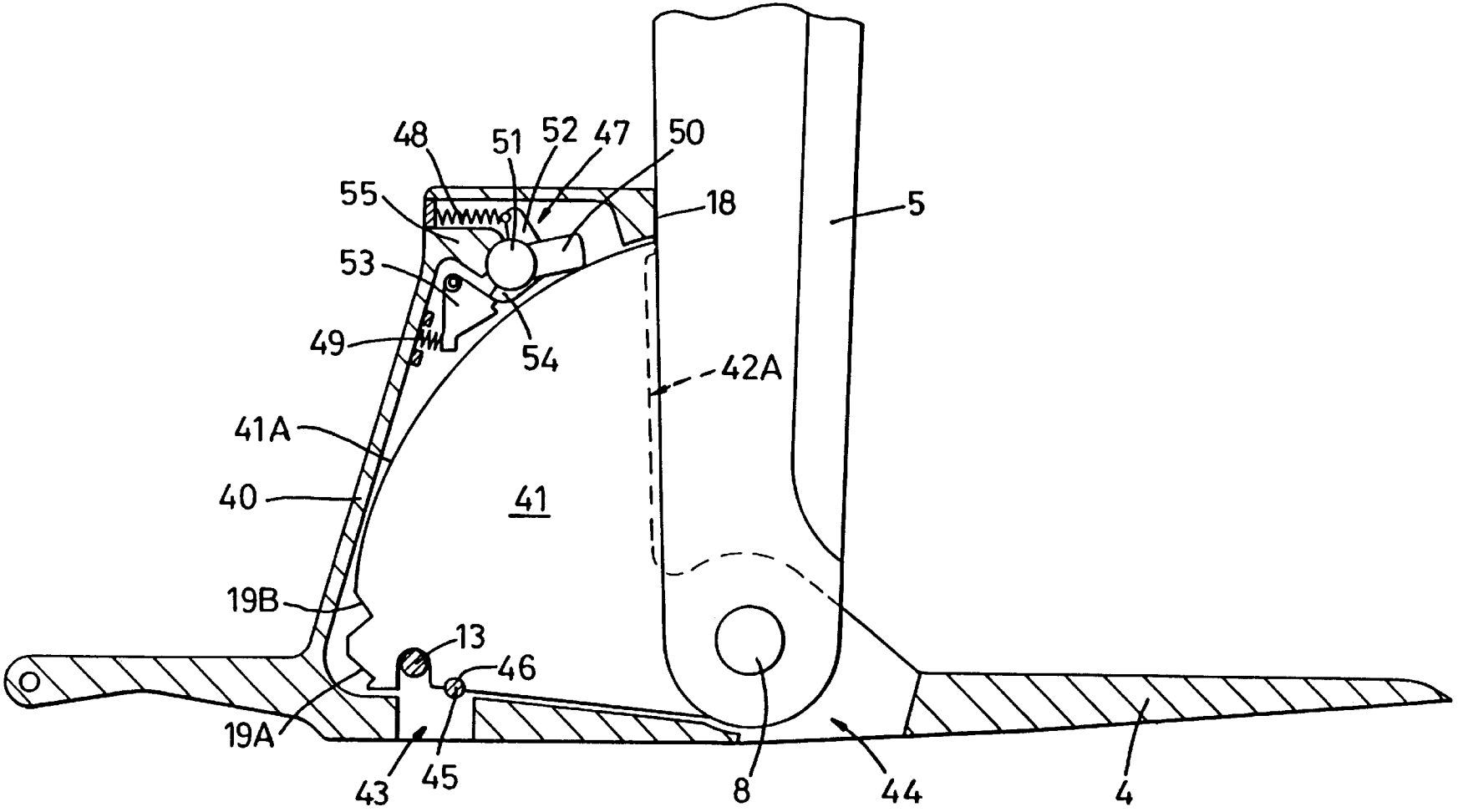
Figure 11D:
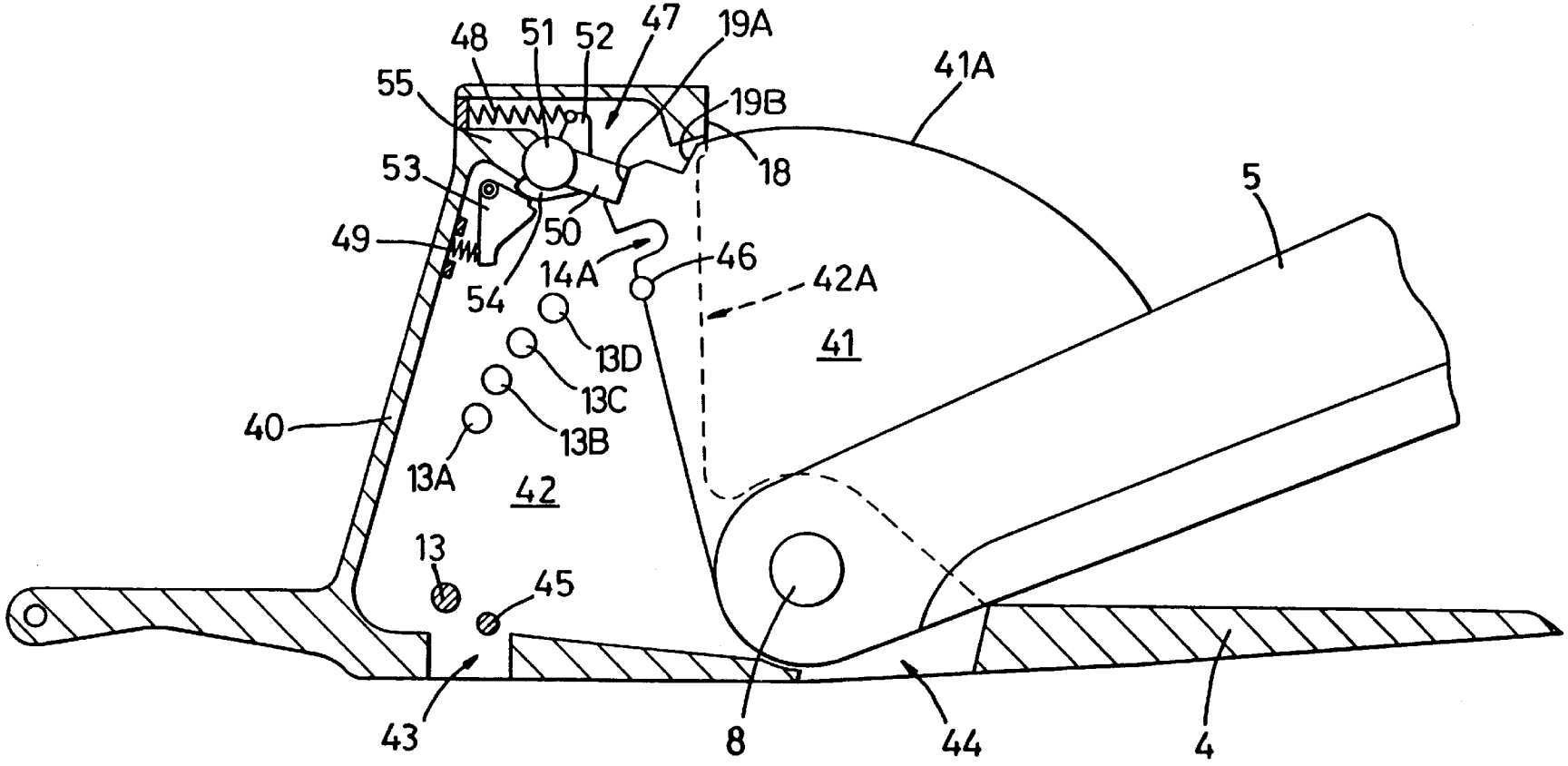

During this motion the edge 41A of quadrant 41 trips plate 53 to free or cock the pawl 50. FIG. 11C shows the situation with pin 13 fractured and the shank 5 in the normal position arrested by abutment 18. When the shank 5 is swung forward to close with the fluke 4 for anchor retrieval ideally the pawl 50 will engage the detent 19A to set the shank at a low angle as shown in FIG. 11D: however in certain situations such a degree of forward swinging may not be possible but in this case arrestment can be achieved via the additional detent 19B. It will be noted in FIG. 11D how substantial loading can be handled by virtue of the pawl 50 being supported on the step 55. The bolts 19 of the previous embodiment may not be able to handle substantial loading. The quadrant 41 as it moves backwards will push grease out of the housing 40 via aperture 43 and 44.

When the anchor is back on deck, the pawl mechanism 47 can be re-set by rotating the shaft 51 anti- clockwise, and it will be necessary to clean out the housing 40 before re-packing with fresh grease. By virtue of the aperture 44 a supplementary benefit is that the pin 8 can be lubricated by the grease.

Modifications of the construction details of the Denla are, of course, possible. In particular, the shank may be formed of more than one member and may even be formed from wire rope. Instead of a fabricated form, the fluke 4 can be of a cast design (as shown in FIGS. 11A to 11D) and this should provide an even grater streamline fluke form beneficial of penetration of the sea bed for deep anchor burial.

I claim:

1. An anchoring apparatus for drag embedment in a submerged soil by means of an anchor cable including a drag embedment normal load anchor comprising a fluke and a shank attached thereto, said shank including an anchor cable attachment point characterized in that first, second, and third directions from the centroid of the fluke to the anchor cable attachment point are provided with the third direction forming a third forward-opening angle (θ) with the forward direction (F) of the fluke smaller than the second forward-opening angle (β) formed by said second direction with said forward direction (F), and first, second, and third restraint means are provided to maintain the anchor cable in use of the anchoring apparatus at said attachment point in said first, second, and third directions respectively whereby, following rotation of the embedded anchor due to pulling the anchor cable upwards and backwards at the attachment point lying in the second direction to cause the fluke forward direction (F) to become inclined upwards, further pulling of the anchor cable forwards and upwards at the attachment point lying in said third direction causes the anchor to move during recovery to the sea bed surface substantially in the now upwardly inclined forward direction of the fluke with consequent low edge wise motional resistance of the fluke in the soil.

2. The anchoring apparatus as claimed in claim 1, wherein said second forward-opening angle (β) lies in the range 84° to 96°.

3. The anchoring apparatus as claimed in claim 2, wherein said second forward-opening angle (β) is approximately 90°.

4. The anchoring apparatus as claimed in claim 1, wherein that said third forward-opening angle (θ) does not exceed 43°.

5. The anchoring apparatus as claimed in claim 1, wherein that said third forward-opening angle (θ) does not exceed 36°.

6. The anchoring apparatus as claimed in claim 1, wherein the shank comprises an elongate rigid shank member with the anchor cable attachment point at one end and pivotally connected at the other end to the fluke by a pivot pin in the region of the centroid of the fluke, said shank being pivotable between said first, second, and third restraint means whereby a straight line containing the fluke centroid and the cable attachment point may successively occupy the first, second, and third directions provided.

7. The anchoring apparatus as claimed in claim 6, wherein the first restraint means is remotely releasable and comprises a shearable pin between the shank member and the fluke which locks the shank member to the fluke and prevents it from pivoting until a predetermined value of moment of force in the anchor cable about the pivot pin is applied which shears the shearable pin.

8. The anchoring apparatus as claimed in claim 6, wherein the second restraint means comprises a rigid stop member attached to one of the fluke and the shank member which by one-way arrestment limits backward pivoting of the shank member.

9. The anchoring apparatus as claimed in claim 8, wherein the third restraint means comprises a latch mechanism which locks the shank member to the fluke following forward pivoting of the shank member from contract with the rigid stop member.

10. The anchoring apparatus as claimed in claim 9, wherein the latch mechanism comprises a spring loaded bolt mounted on one of the fluke and the shank member which is engageable in a mating hole in a plate member rigidly attached to the other one of the fluke and the shank member.

11. The anchoring apparatus as claimed in claim 8, wherein the third restraint means comprises a ratchet mechanism which locks the shank member to the fluke following forward pivoting of the shank member from contract with the rigid stop member.

12. The anchoring apparatus as claimed in claim 11, wherein the ratchet mechanism permits said shank to be moved forward to close with the fluke and be set in position so that said third direction can adopt any one of a plurality of settings, said ratchet mechanism including a moveable pawl having a carrying member which is substantially supported on a bearing surface.

13. The anchoring apparatus as claimed in claim 1, wherein a drogue is attached to and streamable from a rear position of the fluke, said drogue being chosen in size to produce a drag force due to soil friction when embedded sufficient to induce forward pivoting of the shank member relative to the fluke on movement of the anchor in the soil caused by pulling on the attached cable.

14. The anchoring apparatus as claimed in claim 13, wherein the drogue attached to the rear of the fluke comprises a length of wire rope connected to and followed by a length of a heavy chain.

15. The anchoring apparatus as claimed in claim 14, wherein the length of the drogue is between 1.5 and 4 times the length of the fluke.

16. The anchoring apparatus as claimed in claim 1, wherein there is provided a further, preliminary, restraint means for setting the shank in a preliminary position with a forward opening angle less than the first forward opening angle defined by the angle of said first direction relative to the fluke, said preliminary restraint means being releasable to permit the shank to move backwards so that the cable attachment point lies in said first direction for anchor embedment.

17. The anchoring apparatus as claimed in claim 16, wherein said preliminary restraint means comprises a shear pin with a relatively light breaking load.

18. The anchoring apparatus as claimed in claim 1, wherein means are applied at said restraint means to prevent or mitigate against ingress thereto of particles such as grit during anchor embedment so as to endanger satisfactory subsequent functioning of said restraint means.

19. An anchoring apparatus for drag embedment in a submerged soil by means of an anchor cable comprising an anchor, wherein a drogue is attached to a rear portion of the anchor, which drogue hangs vertically as the anchor is lowered proximal to the sea bed surface while suspended by the anchor cable whereby, when the anchoring apparatus is moved horizontally with a portion of the drogue dragging in contact with the sea bed surface, a horizontal motional resistance force is produced by the drogue to constrain the suspended anchor to point only in the direction of dragging motion.

20. The anchoring apparatus as claimed in claim 19, wherein said drogue is attached to a rear portion of the anchor.

21. The anchoring apparatus as claimed in claim 19, wherein an end of said drogue remote from said anchor includes a resistive element capable of providing considerable motional resistance when dragged in contact with the sea bed surface.

22. The anchoring apparatus as claimed in claim 19, wherein said resistive element comprises a length of heavy chain.

23. The anchoring apparatus as claimed in claim 19, wherein the drogue comprises a drogue line, and the length of said drogue line is between 1.5 and 4 times the length of the fluke of the anchor.

24. A marine anchor comprising a fluke and a shank connected thereto, said shank including an anchor cable attachment point and restraint control means for the control of operational settings of the anchor wherein said restraint control means are located in a substantially enclosed housing adapted to be packed with grease so as to provide protection of the restraint control means from ingress of sea bed particles.

25. A method for installing an anchoring apparatus including an anchor having a fluke and a shank and a drogue attached thereto, comprising the following steps:

(a) lowering the anchoring apparatus by means of an anchor cable toward the sea bed surface until an end portion only of a drogue attached to the suspended anchor rests on the sea bed surface;

(b) moving the anchoring apparatus horizontally to allow motional resistance forces on the drogue to turn the anchor about the axis of the anchor cable to point in the direction of horizontal movement;

(c) recommencing lowering the anchoring apparatus while simultaneously moving it horizontally to bring the anchor fluke into contact with the sea bed surface with the fluke pointing in the direction of movement;

(d) laying out a sufficient scope of anchor cable to permit effective drag embedment of the anchor; and (e) pulling on the laid out anchor cable at said sufficient scope to trip and embed the anchor into the sea bed until the required horizontal capacity has been achieved.

26. A method for installing an anchoring apparatus including a drag embedment normal load anchor having a fluke and a shank, the shank including a cable attachment point and an attached drogue, comprising the following steps:

(a) lowering the anchoring apparatus by means of an anchor cable toward the sea bed surface until an end portion only of the drogue attached to the suspended anchor rests on the sea bed surface;

(b) moving the anchoring apparatus horizontally to allow motional resistance forces on the drogue to turn the anchor about the axis of the anchor cable to point in the direction of horizontal movement;

(c) recommencing lowering of the anchoring apparatus while simultaneously moving it horizontally to bring the anchor fluke into contact with the sea bed surface with the fluke pointing in said direction of horizontal movement;

(d) laying out a sufficient scope of anchor cable to permit effective drag embedment of the anchor; and (e) pulling on the laid out anchor cable at said sufficient scope to trip and embed the anchor into the sea bed until the required horizontal capacity has been achieved with the cable attachment point located in first direction;

(f) pulling the laid out anchor cable back over the embedded anchor to bring the cable attachment point into a second direction; and (g) pulling the anchor cable in the direction to cause the anchor to be rotated backwards until the fluke becomes substantially normal to the direction of pull applied at the anchor cable attachment point and the fluke forward direction is inclined ready for mooring service and subsequent recovery.

27. A method for installing and recovering an anchoring apparatus including an anchor having a fluke and a shank and a drogue attached thereto, comprising the following steps:

(a) lowering the anchoring apparatus by means of an anchor cable toward the sea bed surface until an end portion only of the drogue attached to the suspended anchor rests on the sea bed surface;

(b) moving the anchoring apparatus horizontally to allow motional resistance forces on the drogue to turn the anchor about the axis of the anchor cable to point in the direction of horizontal movement;

(c) recommencing lowering the anchoring apparatus while simultaneously moving it horizontally to bring the anchor fluke into contact with the sea bed surface with the fluke pointing in the direction of movement;

(d) laying out a sufficient scope of anchor cable to permit effective drag embedment of the anchor;

(e) pulling on the laid out anchor cable to trip and embed the anchor into the sea bed until the required horizontal capacity has been achieved;

(f) heaving up on the anchor cable to rotate the anchor in the sea bed soil to incline the fluke forward direction (F) upwards towards the sea bed surface; and (g) continuing heaving to move the anchor along the inclined direction of the fluke to the sea bed surface and ultimate recovery from the water.

28. A method for installing an anchoring apparatus to moor a vessel in position and for recovering said anchoring apparatus, said anchoring apparatus including a drag embedment normal load anchor having a fluke and a shank, the shank including a cable attachment point, and an attached drogue, said method comprising the following steps:

(a) lowering the anchoring apparatus by means of an anchor cable towards the sea bed surface until an end portion only of the drogue attached to the suspended anchor rests on the sea bed surface;

(b) moving the anchoring apparatus horizontally away from the position of the vessel to be moored to allow motional resistance forces on the drogue to turn the anchor about the axis of the anchor cable to point in the direction of horizontal movement;

(c) recommencing lowering of the anchoring apparatus while simultaneously moving it horizontally away from the position of the vessel to be moored to bring the anchor fluke into contact with the sea bed surface with the fluke pointing in the said direction of horizontal movement;

(d) laying out a sufficient scope of anchor cable to permit effective drag embedment of the anchor;

(e) pulling on the laid out anchor cable at sufficient scope to trip and embed the anchor into the sea bed until the required horizontal capacity has been achieved with the cable attachment point located in a first direction;

(f) pulling the laid out anchor cable back over the embedded anchor to bring the cable attachment point into a second direction;

(g) pulling the anchor cable in the direction to cause the anchor to be rotated backwards until the fluke becomes substantially normal to the direction of pull applied at the anchor cable attachment point and the fluke forward direction is inclined upwards reach for mooring service and subsequent recovery;

(h) picking up the anchor cable and, from a position on the far side of the embedded anchor from the position of the vessel to be moored, pulling forwards and upwards on the anchor to bring the cable attachment point into a third direction for anchor recovery; and (I) continuing heaving to move the anchor along the inclined direction of the fluke to the sea bed surface and ultimate recovery.

29. A method of installing a drag embedment anchor in a sea bed for the mooring of a vessel, said anchor including a fluke and a shank attached to the fluke, the shank including an anchor cable attachment point, said method comprising the following steps:

(a) placing the anchor on the sea bed surface with an anchor cable attached to the anchor cable attachment point and positioned such that the fluke tip points in the desired direction (F) of embedment of the anchor;

(b) laying out a sufficient scope of anchor cable and pulling on said anchor cable in said embedment direction to embed the anchor with the cable attachment point located in a first direction until a desired horizontal loading capacity has been attained in the anchor cable;

(c) adjusting the position of the shank to bring the cable attachment point into a second direction; and (d) pulling on the anchor cable in a direction to cause the anchor to be rotated backwards until the fluke becomes substantially normal to the direction of pull applied at the anchor cable attachment point with the fluke's forward direction (f) inclined upwards.

* * * * *